US005942881A

United States Patent [19]

Okada et al.

[11] Patent Number: 5,942,881

[45] Date of Patent: Aug. 24, 1999

[54] CONSTANT-VOLTAGE POWER SUPPLY CIRCUIT WITH A CURRENT LIMITING CIRCUIT

[75] Inventors: Hiroyuki Okada; Koichi Inoue, both of Kyoto, Japan

[73] Assignee: Rohm Co. Ltd., Kyoto, Japan

[21] Appl. No.: 08/996,189

[22] Filed: Dec. 22, 1997

[30] Foreign Application Priority Data

Dec. 27, 1996 [JP] Japan ..... 8-351038

[51] Int. Cl.[6] ..... G05F 1/573

[52] U.S. Cl. ..... 323/277; 323/901; 323/908; 363/49; 361/18

[58] Field of Search ..... 363/49, 50, 74; 323/312, 313, 314, 315, 316, 273, 274, 275, 276, 277, 279, 280, 901, 908; 361/18, 93, 57

[56] References Cited

U.S. PATENT DOCUMENTS 5,365,161 11/1994 Inoue et al. ..... 363/74 X 5,550,462 8/1996 Nakajima ..... 323/277

5,710,508 1/1998 Watanabe ..... 323/284

*Primary Examiner*—Peter S. Wong

*Assistant Examiner*—Y. J. Han

*Attorney, Agent, or Firm*—Nikaido Marmelstein Murray & Oram, LLP

[57] ABSTRACT

A power supply unit has an output transistor and two resistors connected in series between a power source line and a ground potential point. The output electrode of the output transistor is connected to an output terminal. Between the output terminal and the ground potential point, a capacitor is connected. When a starting switch is turned on, the output transistor starts conducting. A current limiting circuit is also provided to limit the current that flows through the output transistor when it starts conducting. The current limiting circuit bypasses part of the output current of a comparator to the ground potential point.

9 Claims, 4 Drawing Sheets

CONSTANT-VOLTAGE POWER SUPPLY CIRCUIT WITH A CURRENT LIMITING CIRCUIT

BACKGROUND OF THE INVENTION

1. Field of the Invention

The present invention relates to a power supply unit for supplying electric power to a load circuit.

2. Description of the Prior Art

FIG. 5 shows a conventional constant-voltage power supply unit. This power supply unit is constructed and operates as follows. Between a power source line 36 having a voltage $V_{CC}$ and a ground potential point (reference potential point), a pnp-type output transistor Tr and a first and a second resistor R11 and R12 are connected in series in this order from the power source line 36. The node a between the collector of the output transistor Tr and the first resistor R11 is connected to an output terminal 34.

The node b between the first and second resistors R11 and R12 is connected to the non-inverting input terminal (+) of a comparator 33. The inverting input terminal (−) of the comparator 33 is connected to the node d between one end of a resistor $R_0$ and one end of a starting switch 32. The other end of the resistor $R_0$ is connected to the ground potential point, and the other end of the starting switch 32 is connected through a constant current source 31 to the power source line. Assume that, when the starting switch 32 is turned on, the voltage at the node d is $V_{11}$. To the output terminal 34, a capacitor 35 is connected to prevent oscillation.

A load 37 is connected to the output terminal 34. In reality, the capacitance of the load 37 acts as another capacitor connected in parallel with the capacitor 35. Here, however, for simplicity's sake, it is assumed that the capacitor 35 includes the capacitance of the load 37. The entire power supply unit starts operating when the switch 32 is turned on.

When the switch 32 is turned on, the voltage $V_{11}$ at the node d is applied to the inverting input terminal (−) of the comparator 33. This causes the comparator 33 to output a low level, turning on the output transistor Tr. As a result, the capacitor 35 is charged quickly. When the voltage at the node b exceeds $V_{11}$, the comparator 33 outputs a high level, turning off the output transistor Tr. However, as more current is supplied to the load 37, the voltage at the node b becomes lower until eventually the output transistor Tr is turned on again. In this way, the output transistor Tr is so controlled as to keep the voltage at the node b, thus the voltage at the output terminal 34, constant.

In this conventional power supply unit, as soon as the switch 32 is turned on to start up the unit, a current as high as the unit permits flows through the capacitor 35. As a result, as the characteristic curve in FIG. 6 shows, the power supply unit at first outputs its maximum current Imax that is higher than the current $I_0$ that should normally be supplied to the load, and, only after that, the output current, tracing the characteristic curve from point A to B, to C, and eventually to D, settles to its normal value.

Inconveniently, such a flow of maximum current Imax at the start-up makes the source of the output current, that is, the power source line 36, unstable. This may lead to malfunctioning of other circuits 38 and 39 that are connected to the same power source line 36. For example, if the circuit 38 or 39 contains a microcomputer, the microcomputer may be reset unexpectedly.

SUMMARY OF THE INVENTION

An object of the present invention is to provide a power supply unit that does not cause a flow of an unduly large amount of current when it is started up by means of a starting switch.

To achieve the above object, according to one aspect of the present invention, a power supply unit, in which a transistor and a resistor are connected in series between a power source line and a reference potential point; an output terminal is connected to a node between the transistor and the resistor; a capacitor is connected between the output terminal and the reference potential point; and a starting switch is operated to cause the transistor to start conducting, is further provided with an overcurrent preventing circuit for limiting a current that flows through the transistor when the transistor starts conducting.

According to another aspect of the present invention, a constant-voltage power supply unit, in which a pnp-type output transistor, a first resistor, and a second resistor are connected in series between a power source line and a reference potential point; an output terminal is connected to a node between a collector of the output transistor and the first resistor; a capacitor is connected between the output terminal and the reference potential point; a base of the output transistor is connected to an output of a comparator; a voltage at a node between the first and second resistors is fed to the comparator as its first input; and a predetermined direct-current voltage is fed to the comparator as its second input when a starting switch is turned on, is further provided with an overcurrent preventing circuit for limiting an output current of the output transistor when the starting switch is turned on to start up the constant-voltage power supply unit.

According to still another aspect of the present invention, a power supply unit is provided with an output transistor whose one end is connected to a power source line; an output terminal connected to an output electrode of the output transistor; a resistor circuit whose one end is connected to the output electrode of the output transistor and whose other end is connected to ground; a starting circuit for producing a starting voltage for starting the power supply unit; a comparator for comparing a voltage at a predetermined point in the resistor circuit with the starting voltage to control conductance of the output transistor in accordance with a comparison output of the comparator; an auxiliary transistor whose one end is connected to the power source line and which receives at its control electrode the comparison output of the comparator; and an overcurrent preventing circuit for limiting an output current of the output transistor by way of the comparator in accordance with a current outputted from the auxiliary transistor and a voltage at the output terminal when the power supply unit is started up.

According to a further aspect of the present invention, a power supply unit is provided with a pnp-type output transistor whose emitter is connected to a power source line; an output terminal connected to a collector of the output transistor; a resistor circuit whose one end is connected to the collector of the output transistor and whose other end is connected to ground; a starting circuit for producing a starting voltage for starting the power supply unit; a comparator for comparing a voltage at a predetermined point in the resistor circuit with the starting voltage to control conductance of the output transistor in accordance with a comparison output of the comparator; an auxiliary transistor whose emitter is connected to the power source line and which receives at its base the comparison output of the comparator; and an overcurrent preventing circuit for limiting an output current of the output transistor in accordance with a collector current of the auxiliary transistor and a voltage at the output terminal when the power supply unit is started up. This power supply unit may be further provided with a third transistor of an npn type that has its collector connected to bases of the auxiliary and output transistors, has its emitter connected to ground, and receives at its base the comparison output of the comparator.

In this power supply unit, the overcurrent preventing circuit is provided with a current limiting circuit and an output voltage delay circuit, and the current limiting circuit is provided with a fourth transistor of an npn type that has its collector connected to the base of the third transistor, has its emitter connected to ground, and has its base connected to a collector of the auxiliary transistor; a first resistor whose one end is connected to the collector of the auxiliary transistor and whose other end is connected to ground; and a serial circuit, connected in parallel with the first resistor, composed of a second resistor and a switching element connected in series, the switching element being controlled by an output of the output voltage delay circuit.

Alternatively, the overcurrent preventing circuit is provided with a current limiting circuit and an output voltage delay circuit, and the current limiting circuit is provided with a fourth transistor of an npn type that has its collector connected to the base of the third transistor, has its emitter connected to ground, and has its base connected to a collector of the auxiliary transistor; a fifth transistor of an npn type that has its collector and base connected to the collector of the auxiliary transistor and has its emitter connected to ground; and a sixth transistor that has its collector connected to the collector of the fifth transistor and has its emitter connected to ground, the sixth transistor receiving at its base an output of the output voltage delay circuit.

BRIEF DESCRIPTION OF THE DRAWINGS

This and other objects and features of this invention will become clear from the following description, taken in conjunction with the preferred embodiments with reference to the accompanied drawings in which:

FIG. 6 is a characteristic curve of the output current of the conventional power supply unit as observed when it is started up.

DESCRIPTION OF THE PREFERRED EMBODIMENTS

Figure 1:
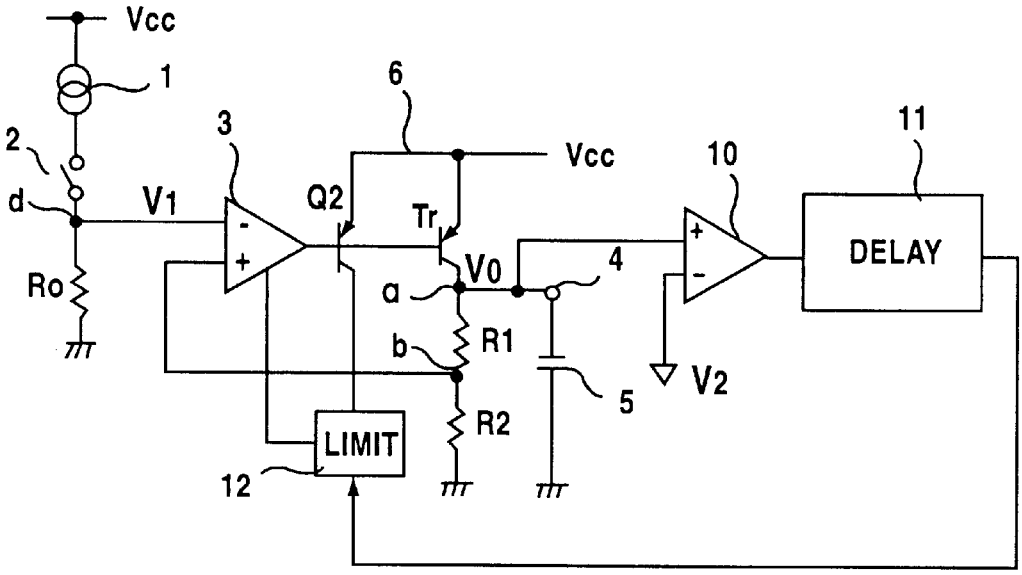
FIG. 1 is a circuit diagram of a constant-voltage power supply unit embodying the invention.

FIG. 1 shows a constant-voltage power supply unit embodying the present invention. This power supply unit is constructed and operates as follows. Between a power source line 6 having a voltage $V_{CC}$ and a ground potential point (reference potential point), a pnp-type output transistor Tr and a first and a second resistor R1 and R2 are connected in series in this order from the power source line 6. The node a between the collector of the output transistor Tr and the first resistor R1 is connected to an output terminal 4.

The node b between the first and second resistors R1 and R2 is connected to the non-inverting input terminal (+) of a comparator 3. The inverting input terminal (−) of the comparator 3 is connected to the node d between one end of a resistor $R_0$ and one end of a starting switch 2. The other end of the resistor $R_0$ is connected to the ground potential point, and the other end of the starting switch 2 is connected through a constant current source 1 to the power source line. Assume that, when the starting switch 2 is turned on, the voltage at the node d is $V_1$. To the output terminal 4, a capacitor 5 is connected to prevent oscillation.

Figure 5:
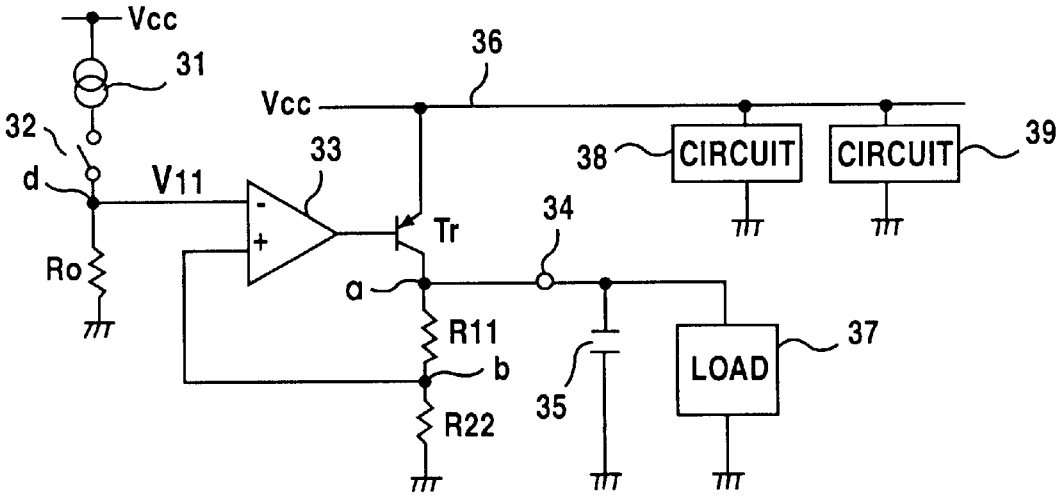
FIG.5 PRIOR ART
FIG. 5 is a circuit diagram of a conventional constant-voltage power supply unit.

A load (not shown) is connected to the output terminal 4. In reality, the capacitance of the load acts as another capacitor connected in parallel with the capacitor 5. Here, however, for simplicity's sake, it is assumed that the capacitor 5 includes the capacitance of the load. To the power source line 6, other circuits, such as the circuits 38 and 39 shown in FIG. 5, are connected as well. Such circuits 38 and 39 may contain a microcomputer. The power supply unit of the embodiment is further provided with an auxiliary transistor Q2, a comparator 10, a delay circuit 11, and a current limiting circuit 12. The auxiliary transistor Q2 is a pnp-type transistor, and has its emitter connected to the power source line 6 and its base connected to the output of the comparator 3. The ratio of the current flowing through the auxiliary transistor Q2 to that flowing through the output transistor Tr is set to 1:n (where $n \geqq 1$). The current limiting circuit 12 serves to limit the output current of the comparator 3 and thereby limit the output current of the output transistor Tr.

The comparator 10 compares the voltage $V_0$ at the output terminal 4 with a predetermined direct-current voltage $V_2$. The delay circuit 11 lets the current limiting circuit 12 perform its current limiting operation until the voltage $V_0$ at the output terminal 4 reaches $V_2$, and deactivates it when $V_0$ reaches $V_2$. Thus, the comparator 10, the delay circuit 11, and the current limiting circuit 12 constitute an overcurrent preventing circuit for preventing a flow of an unduly large amount of current when the power supply unit is started up. The circuit shown in FIG. 1 may be formed as an IC (integrated circuit) except for the starting switch 2 and the capacitor 5.

Figure 3:
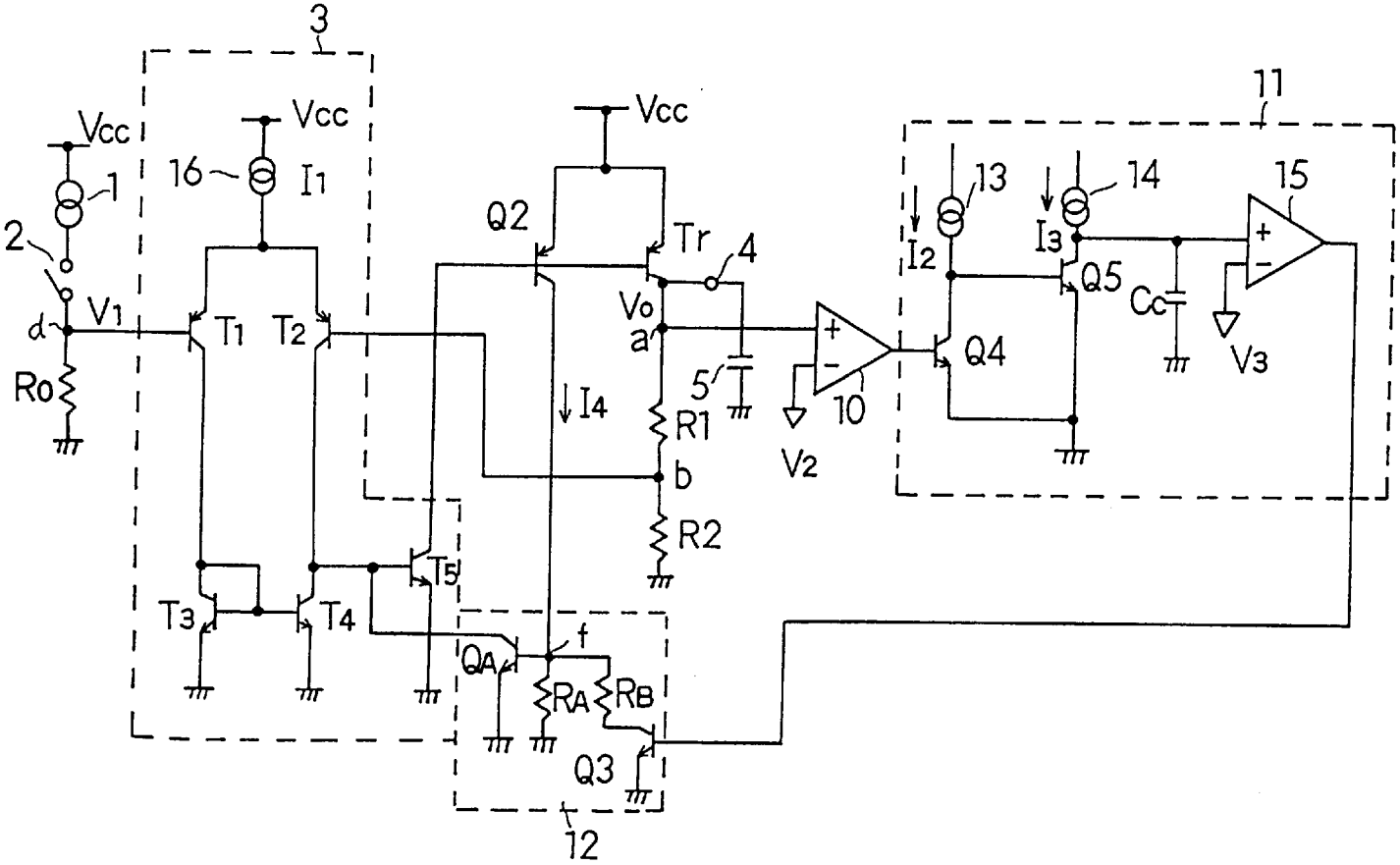
FIG. 3 is a circuit diagram more particularly showing the construction of the circuit shown in FIG. 1.

FIG. 3 is a circuit diagram that more particularly shows the construction of the comparator 3, the delay circuit 11, and the current limiting circuit 12 of the circuit shown in FIG. 1. The comparator 3 is composed of a constant current source 16, a pair of pnp-type transistors T1 and T2 that both have their emitters connected to the constant current source 16, a pair of npn-type transistors T3 and T4 that are connected to the collectors of the transistors T1 and T2, respectively, and that form a current mirror circuit, and a comparator output transistor T5.

The transistor T5 has its collector connected to the bases of the auxiliary and output transistors Q2 and Tr, and has its emitter connected to the ground potential point. The transistor T1 has its base connected to the node d, and the transistor T2 has its base connected to the node b.

The current limiting circuit 12 is composed of an npn-type transistor $Q_A$ that has its collector connected to the base of the transistor T5 and its emitter connected to the ground potential point, a resistor $R_A$ whose one end is connected to the collector of the auxiliary transistor Q2 and the base of the transistor $Q_A$ and whose other end is connected to the ground potential point, a resistor $R_B$ whose one end is connected to the transistors Q2 and $Q_A$ and the resistor $R_A$, and an npn-type transistor Q3 that has its collector connected to the other end of the resistor $R_B$ and its emitter connected to the ground potential point.

The delay circuit 11 is composed of an npn-type transistor Q4 that receives the output of the comparator 10, a constant current source 13 connected to the collector of the transistor Q4, an npn-type transistor Q5 that has its base connected to the collector of the transistor Q4, a constant current source 14 connected to the collector of the transistor Q5, a capacitor Cc connected between the collector of the transistor Q5 and the reference potential point, and a comparator 15. The comparator 15 receives, at its inverting input terminal (−), a predetermined direct-current voltage $V_3$ and, at its non-inverting input terminal (+), the voltage at the capacitor Cc.

The circuit shown in FIG. 3 operates as follows. When the switch 2 is off, the auxiliary and output transistors Q2 and Tr are in the off state, and therefore the voltage at the node b equals the ground potential. Accordingly, when the switch 2 is turned on, the transistor T2 is turned on; on the other hand, the transistor T1 remains off, and therefore the transistors T3 and T4 also remain off.

As a result, the collector current of the transistor T2 flows into the base of the transistor T5. This turns on the auxiliary and output transistors Q2 and Tr, and the resulting collector current $I_4$ of the auxiliary transistor Q2 causes the voltage at the node f to rise, turning on the transistor $Q_A$. Thus, part of the collector current of the transistor T2 is bypassed through the transistor $Q_A$ to the ground potential point.

Figure 2:
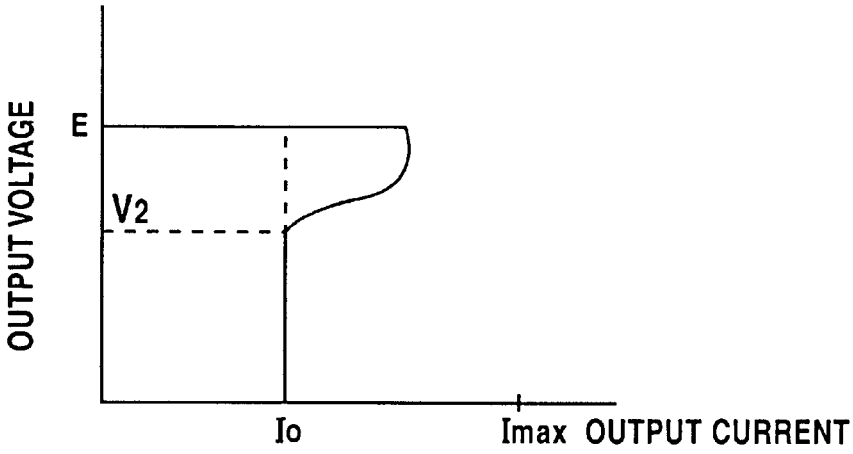
FIG. 2 is a characteristic curve of the output current of the power supply unit of the invention as observed when it is started up.

In this way, the base current of the transistor T5 is limited, and thus the base currents of the auxiliary and output transistors Q2 and Tr are limited. This reduces the conductance of the auxiliary and output transistors Q2 and Tr, and therefore, as shown in FIG. 2, the output transistor Tr outputs a current equal to the current $I_0$ that is normally supplied to the load. Accordingly, the capacitor 5 is charged by this current. During the charging of the capacitor 5, the output voltage $V_0$ is kept lower than $V_2$, so that the comparator 10 keeps its output low and thereby keeps the transistor Q5 on, causing the comparator 15 to keep its output low.

As a result, in the current limiting circuit 12, the transistor Q3 remains off, and therefore no current flows through the resistor $R_B$. Consequently, the current $I_4$ keeps the voltage at the node f relatively high, as compared with when a current is flowing through the resistor $R_B$, and thus accordingly less current flows into the base of the transistor T5 (hence less current to the bases of the auxiliary and output transistors Q2 and Tr). This causes the output transistor Tr to output accordingly less current. The capacitor 5 continues to be charged by the output current thus limited, and, when the voltage across the capacitor 5 exceeds $V_2$, the transistor Q4 is turned off, and the transistor Q5 is turned on, and thereby the charging of the capacitor Cc is started. The current limiting circuit 12 continues its current limiting operation until the voltage across the capacitor Cc exceeds $V_3$.

When the voltage across the capacitor Cc reaches $V_3$, the comparator 15 raises its output to a high level. This turns on the transistor Q3, and causes a current to flow through the resistor $R_B$. As a result, the resistance between the node f and the ground potential point reduces, and thus the voltage at the node f drops. Consequently, less current is bypassed through the transistor $Q_A$.

This, however, does not cause a significant increase in the base current of the transistor T5, because, now, even though less current is bypassed through the transistor $Q_A$, the potential at the node b is higher than before and therefore the collector current of the transistor T2 is accordingly lower.

Figure 4:
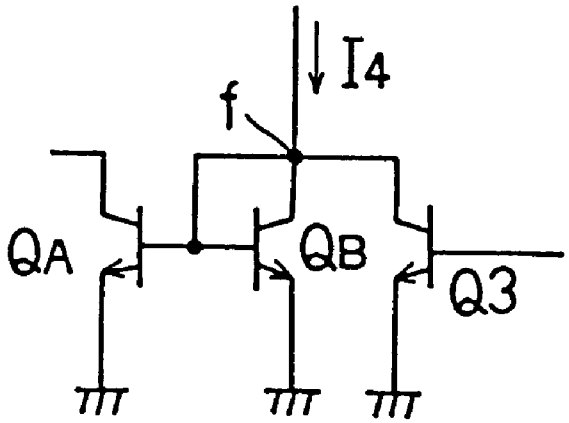
FIG. 4 is a circuit diagram showing a part of a modified example of the power supply unit of the invention.

In the power supply unit of the embodiment described above, the current limiting circuit 12 may be constructed as shown in FIG. 4. In this figure, the transistors $Q_B$ and $Q_A$ form a current mirror circuit, and they are turned off when the transistor Q3 is turned on. Moreover, in the power supply unit of the embodiment, the delay circuit 11 may be omitted. In that case, the transistor Q3 of the current limiting circuit 12 is driven directly by the output of the comparator 10.

As described above, a power supply unit according to the present invention does not cause a flow of an unduly large amount of current when it is started up by means of a starting switch, and therefore it never makes its power source unstable. As a result, in a situation where other circuits including a microcomputer are connected to the same power source, the power supply unit never causes unexpected resetting of the microcomputer.

What is claimed is:

1. A constant-voltage power supply unit in which:

a pnp-type output transistor, a first resistor, and a second resistor are connected in series between a power source line and a reference potential point;

an output terminal is connected to a node between a collector of the output transistor and the first resistor;

a capacitor is connected between the output terminal and the reference potential point;

a base of the output transistor is connected to an output of a comparator;

a voltage at a node between the first and second resistors is fed to the comparator as its first input; and a predetermined direct-current voltage is fed to the comparator as its second input when a starting switch is turned on, wherein the constant-voltage power supply unit further comprises current limiting means for limiting an output current of the output transistor when the starting switch is turned on to start up the constant-voltage power supply unit, wherein the current limiting means comprises a current bypassing circuit for bypassing part of a current output from the comparator to the reference potential point, and a delay circuit, inserted between the output terminal and a control input point of the current bypassing circuit, for keeping the current bypassing circuit operating until a predetermined length of time passes after a voltage at the output terminal reaches a predetermined voltage.

2. A power supply unit comprising:

an output transistor whose one end is connected to a power source line;

an output terminal connected to an output electrode of the output transistor;

a resistor circuit whose one end is connected to the output electrode of the output transistor and whose other end is connected to ground;

a starting circuit for producing a starting voltage for starting the power supply unit;

a comparator for comparing a voltage at a predetermined point in the resistor circuit with the starting voltage to control conductance of the output transistor in accordance with a comparison output of the comparator;

an auxiliary transistor whose one end is connected to the power source line and which receives at its control electrode the comparison output of the comparator; and current limiting means for limiting an output current of the output transistor by way of the comparator in accordance with a current output from the auxiliary transistor and a voltage at the output terminal when the power supply unit is started up.

3. A power supply unit as claimed in claim 2, wherein the current limiting means comprises a current bypassing circuit for bypassing part of a current output from the comparator to ground, and a delay circuit, inserted between the output terminal and a control input point of the current bypassing circuit, for keeping the current bypassing circuit operating until a predetermined length of time passes after a voltage at the output terminal reaches a predetermined voltage.

4. A power supply unit comprising:

a pnp-type output transistor whose emitter is connected to a power source line;

an output terminal connected to a collector of the output transistor;

a resistor circuit whose one end is connected to the collector of the output transistor and whose other end is connected to ground;

a starting circuit for producing a starting voltage for starting the power supply unit;

a comparator for comparing a voltage at a predetermined point in the resistor circuit with the starting voltage to control conductance of the output transistor in accordance with a comparison output of the comparator;

an auxiliary transistor whose emitter is connected to the power source line and which receives at its base the comparison output of the comparator; and current limiting means for limiting an output current of the output transistor in accordance with a collector current of the auxiliary transistor and a voltage at the output terminal when the power supply unit is started up.

5. A power supply unit as claimed in claim 4, further comprising:

a third transistor of an npn type that has its collector connected to bases of the auxiliary and output transistors, has its emitter connected to ground, and receives at its base the comparison output of the comparator.

6. A power supply unit as claimed in claim 5, wherein the current limiting means comprises a current bypassing circuit and an output voltage delay circuit, the current bypassing circuit comprising:

a fourth transistor of an npn type that has its collector connected to the base of the third transistor, has its emitter connected to ground, and has its base connected to a collector of the auxiliary transistor;

a first resistor whose one end is connected to the collector of the auxiliary transistor and whose other end is connected to ground; and a serial circuit, connected in parallel with the first resistor, composed of a second resistor and a switching element connected in series, the switching element being controlled by an output of the output voltage delay circuit.

7. A power supply unit as claimed in claim 6, wherein the output voltage delay circuit does not output a signal for turning on the switching element until a predetermined length of time passes after the voltage at the output terminal reaches a predetermined voltage.

8. A power supply unit as claimed in claim 5, wherein the current limiting means comprises a current bypassing circuit and an output voltage delay circuit, the current bypassing circuit comprising:

a fourth transistor of an npn type that has its collector connected to the base of the third transistor, has its emitter connected to ground, and has its base connected to a collector of the auxiliary transistor;

a fifth transistor of an npn type that has its collector and base connected to the collector of the auxiliary transistor and has its emitter connected to ground; and a sixth transistor that has its collector connected to the collector of the fifth transistor and has its emitter connected to ground, the sixth transistor receiving at its base an output of the output voltage delay circuit.

9. A power supply unit as claimed in claim 8, wherein the output voltage delay circuit does not output a signal for turning on the sixth transistor until a predetermined length of time passes after the voltage at the output terminal reaches a predetermined voltage.

* * * * *